US007112736B2

(12) United States Patent
Hoshiai et al.

(10) Patent No.: US 7,112,736 B2
(45) Date of Patent: Sep. 26, 2006

(54) ELECTRONIC MUSICAL INSTRUMENT

(75) Inventors: Atsushi Hoshiai, Inasa-gun (JP); Kenji Sato, Hamamatsu (JP)

(73) Assignee: Roland Corporation, Osaka (JP)

( * ) Notice: Subject to any disclaimer, the term of this patent is extended or adjusted under 35 U.S.C. 154(b) by 163 days.

(21) Appl. No.: 10/719,872

(22) Filed: Nov. 21, 2003

(65) Prior Publication Data

US 2004/0144237 A1 Jul. 29, 2004

(30) Foreign Application Priority Data

Jan. 10, 2003 (JP) ..... 2003-003841

(51) Int. Cl.
*G10H 7/00* (2006.01)

(52) U.S. Cl. ..... 84/612; 369/30.23

(58) Field of Classification Search ..... 84/600–607, 84/609, 635, 612, 622, 640, 652, 470 R; 369/30.23
See application file for complete search history.

(56) References Cited

U.S. PATENT DOCUMENTS 5,074,182 A * 12/1991 Capps et al. ..... 84/609
6,376,760 B1 * 4/2002 Tozuka et al. ..... 84/635
2002/0100359 A1 * 8/2002 Takahashi ..... 84/609
2003/0103422 A1 * 6/2003 Miyashita et al. ..... 369/30.23
2004/0099125 A1 * 5/2004 Kay ..... 84/609

FOREIGN PATENT DOCUMENTS

JP 2001-188544 7/2001
JP 2002-14676 1/2002

* cited by examiner

*Primary Examiner*—Marlon T. Fletcher
*Assistant Examiner*—Jianchun Qin
(74) *Attorney, Agent, or Firm*—Foley & Lardner LLP

(57) ABSTRACT

An electronic musical instrument enables a phrase that is stored as audio waveform data to be played back at an arbitrary tempo. The instrument includes an operator that allows the performer to change the readout position of the waveform data manually, enabling the performer to increase, decrease or reverse the speed of waveform data playback temporarily. Upon ceasing use of the operator, the playback of the waveform data returns to synchronization with the previously set tempo at a readout position that would be the current readout position had the operator not been used by the performer.

14 Claims, 3 Drawing Sheets

ELECTRONIC MUSICAL INSTRUMENT

RELATED APPLICATIONS

This application claims priority under 35 USC § 119 from Japanese patent application 2003-003841, filed 10 Jan. 2003, the entirety of which is incorporated herein by reference.

BACKGROUND OF THE INVENTION

1. Field of Invention

Embodiments of the present invention relate to an electronic musical instrument. In particular, embodiments of the invention relate to an electronic musical instrument in which a phrase is played back at a tempo that has been set by a user, and in which the user may temporarily change the tempo at which the phrase is played back using a readout position change operator.

2. Related Technology

Electronic musical instruments that play back waveform data representing a phrase comprised of a plurality of bars of musical tones have been known for some time. Some electronic musical instruments allow the playback tempo of the waveform data to be changed. In such instruments, the original tempo of the waveform data is compared to the tempo at which playback is to be carried out, and a difference is determined. Playback of the waveform data is then performed based on the difference. However, it is not possible to change the playback tempo of the waveform data once playback has begun. In this regard, the applicant has proposed in Japanese Unexamined Patent Application Publication (Kokai) Number 2001-188544 an electronic musical instrument that allows a tempo change to occur during playback of waveform data. In this system, a tempo difference is determined at specified periods during playback and playback is carried out while successively modifying the playback position for the waveform data in conformance with the tempo difference at each period.

Other known electronic musical instruments allow the readout position of waveform data to be controlled by the user through the use of an operator. However, in such instruments, the user directly controls the readout position of the waveform data without reference to the amount of the adjustment in units of musical time, making it difficult to adjust playback to a desired position. In this regard, the applicant has proposed in U.S. Published Patent Application Number 2002-0046639 an electronic musical instrument in which the user is enabled to adjust the readout position of waveform data in units of musical time. This enables the performer to adjust the readout position in a manner that produces a predictable performance.

However, in the aforementioned electronic musical instruments, if the readout position of the waveform data is changed during playback at a tempo that has been previously synchronized to another performance such as an accompaniment, the resulting change in readout prevents playback from returning to synchronization with the accompaniment when the readout position change is canceled.

SUMMARY OF THE DISCLOSURE

In accordance with embodiments of the invention, an electronic musical instrument enables a performer to play back waveform data at an arbitrary tempo set by the performer. A readout position change operator is provided which allows the performer to temporarily change the readout positions of the waveform data. The operator may be used by the performer to control the readout positions of the waveform data such that playback of the waveform data is shifted, sped up, slowed down, or reversed with respect to the tempo previously set. Further, when the performer ceases to use the readout position change operator, the waveform data returns to playback at the tempo previously set by the performer, and from a readout position that would have been the current readout position had the readout position change operator not been used. Therefore the readout position change operator enables the performer to manipulate the timing, speed and direction of reproduction of the waveform data as it is performed, and returning reproduction of the waveform data to synchronization with the previously set tempo when such manipulation is ceased. Consequently, the performer can, for example, manipulate the playback of waveform data with respect to an accompaniment such as by shifting, speeding or slowing playback of the waveform data, and then automatically return the playback of the waveform data to synchronization with the accompaniment.

In accordance with one embodiment of the invention, the readout position change operator is provided in the form of a flat pressure sensitive surface. The performer may use the operator by applying pressure to the surface and moving the location of the applied pressure, thus indicating the direction and amount of readout position change. In a preferred embodiment, the direction and amount of readout position change may be indicated by the amount of angular movement of the location of pressure relative to a reference point such as the center of the surface, and the removal of pressure from the surface may indicate termination of use of the operator. In accordance with another embodiment of the invention, the readout position change operator is provided in the form of a bender lever. The lever may be moved to indicate the direction and amount of readout position change, and the lever may be moved to a position indicating termination of use of the bender.

DETAILED DESCRIPTION OF PREFERRED EMBODIMENTS

An explanation will be given below regarding preferred embodiments of the present invention while referring to the accompanying drawings.

Figure 1:
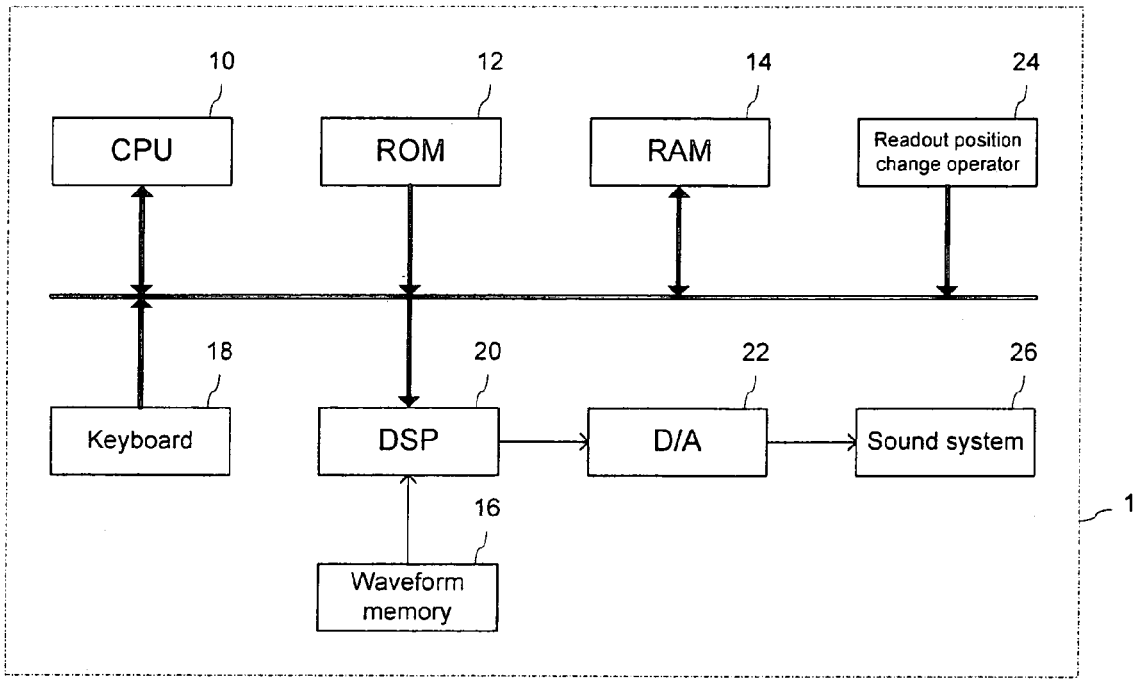
FIG. 1 is a block diagram that shows the elements of an electronic musical instrument in accordance with a first preferred embodiment.

FIG. 1 is a block diagram that shows components of an electronic musical instrument 1 in accordance with a first preferred embodiment of the invention. The electronic musical instrument 1 is comprised of a CPU 10 that controls the electronic musical instrument 1, a ROM 12 that stores a control program for the CPU 10 and various data tables, and a RAM 14 having a working area that provides registers used by the control program and temporary areas in which the data being processed are stored. The instrument 1 further comprises a waveform memory 16 for storing waveform data for audio signals such as musical instrument sounds and human voices as well as data related to the waveform data, a keyboard 18 that directs the starting and stopping of the reproduction of the audio waveforms, a digital signal processor (DSP) 20 that performs computational processing to generate digital audio signals from the waveform data, a digital to analog converter (D/A) 22 that converts the digital signals from the DSP 20 into analog signals, and a sound system 26 comprised of an amplifier and speaker for generating sounds from the analog signals provided by the D/A 22. The instrument further comprises a readout position change operator 24 that may be operated by a user to temporarily change the readout position of the waveform data to produce effects such as shifting, speeding, slowing or reversing of waveform reproduction with reference to a set tempo. The aforementioned components are connected by a bus (indicated by the thick line in FIG. 1) that carries input and output data.

The waveform memory 16 stores waveform data that represents an audio waveform. The waveform data may comprise pulse code modulation (PCM) data obtained by sampling the audio waveform at a given sampling rate. The sampled data are preferably stored continuously at sequential addresses of the waveform memory 16. The waveform memory also stores related data such as a "Wavestart" position indicating the start of the waveform data for the audio waveform, a "Waveend" position indicating the end of the waveform data for the audio waveform, a "Playstart" position indicating a playback start position, and a "Playend" position indicating a playback end position. In the preferred embodiment, the segment from the playback start Playstart to the playback end Playend comprises four bars.

The keyboard 18 is used for the output of performance information by the performer. In the first preferred embodiment, key pressing information generated by the keyboard initiates reproduction of an audio waveform by the pressing of any of the keys of the keyboard 18, and key releasing information terminates reproduction of the audio waveform. The key pressing information includes pitch information which is used to set the pitch at which the audio waveform is played back.

In accordance with a first preferred embodiment the readout position change operator 24 is preferably comprised of a pressure sensitive polar coordinate position detection device. When the performer presses on the readout position change operator 24, the coordinates (X, Y) that have been pressed and the pressure P are detected by the CPU 10. The movement of the location of pressure on the readout position change operator 24 represents the type of control over the readout position that is intended by the performer, as discussed in more detail below.

The instrument 1 further comprises additional operators and display devices that indicate settings and execution states. In particular, the instrument of the preferred embodiment includes a tempo setting operator that may be used by a performer to set a desired playback tempo, and an automatic performance initiating operator for initiating playback of automatic performance data.

An example will be given here of the operation of an electronic musical instrument 1 that has been configured as discussed above. First, the performer selects any desired automatic performance data from among automatic performance data stored in the RAM 14 using a playback data selection operator, and selects any desired audio waveform data stored in the waveform memory 16. The performer then sets a playback tempo at which the data are to be played back using the tempo setting operator. When performance is initiated by means of the automatic performance initiation operator, playback of the automatic performance data begins. The automatic performance data are read out from the RAM 14 and played back at the playback tempo that has been set by the performer using the tempo setting operator. The automatic performance data are processed by the DSP 20 to generate a digital signal representing musical tones, which is converted to an analog signal by the D/A 22 and emitted by the sound system 26.

The performer may initiate playback of the selected waveform data by pressing any of the keys of the keyboard 18. When a key is pressed and the key pressing information is detected by the CPU 10, the waveform data is played back at a pitch corresponding to the particular key that is pressed, and at the tempo set by the performer using the tempo setting operator. Thus the playback of the waveform data is synchronized with the beats and bars of the automatic performance data. The waveform data are processed by the DSP 20 to generate a digital audio signal representing musical tones.

If the performer operates the readout position change operator 24, the readout position of the waveform data is changed in conformance with the amount of the operation. The readout position change operator 24 enables the performer to change the readout position in a number of manners to produce different effects. The readout position may be moved forward or backward by a fixed amount, thus shifting the waveform data with respect to the automatic performance data. The readout position may be moved forward at successively greater amounts, thus speeding the waveform with respect to the automatic performance data, or at successively smaller amounts, thus slowing the waveform with respect to the automatic performance data. The readout position may also be moved backward, thus creating a reversing effect. If the operator 24 is operated at a high speed, the readout position of the waveform data changes quickly, while if the operator is operated slowly, the readout position of the waveform data changes slowly.

When the performer ceases operation of the readout position change operator 24 by removing pressure from the operator 24, playback of the audio waveform data returns to the playback tempo that was previously set using the tempo setting operator, and readout of the audio waveform data returns to a readout position that would be the present readout position at the previously set tempo if there had been no operation of the readout position change operator 24. Thus the playback of the waveform effectively returns to synchronization with the automatic performance data. In the implementation of the first preferred embodiment, the return to the new readout position may produce noise, and so it is preferred to gradually decrease the volume of waveform data reproduction at the altered readout position while concurrently initiating playback at the new readout position and gradually increasing the volume of the reproduction from the new readout position. This type of transition may be referred to as a cross-feed.

Figure 2:
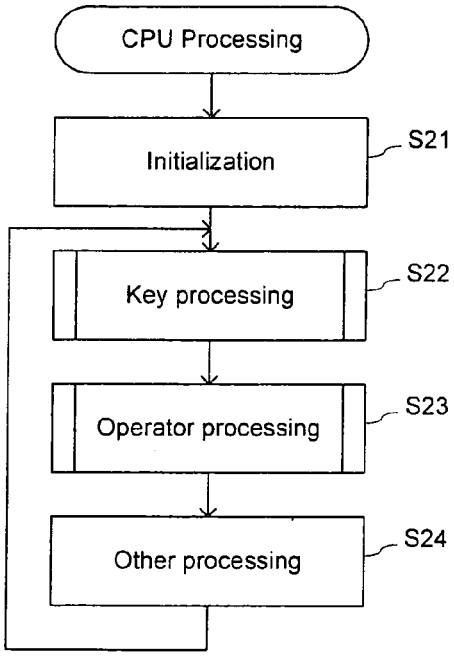
FIG. 2 is a flowchart showing main processing performed by a CPU in accordance with the first preferred embodiment.

Basic processing performed by an electronic instrument in accordance with the first preferred embodiment is shown in FIG. 2. The processing of FIG. 2 is repeatedly executed by the CPU 10 during the time that power is supplied to the electronic musical instrument 1.

In the basic processing, the CPU 10 first executes initialization (S21) such as clearing the various types of registers when power is supplied. The CPU 10 then carries out key processing (S22) in which the states of the keys of the keyboard 18 are detected, such as key pressing information, pitch, and key releasing information.

When key processing S22 has been completed, operator processing is executed (S23). Operator processing detects the settings of operators such as the tempo setting operator, the automatic performance initiating operator, and the readout position change operator 24. The detected state of the tempo setting operator is used to generate an internal tempo clock. The detected state of the automatic performance initiating operator is used to initiate performance of automatic performance data. The detected state of the readout position change operator 24 is used to implement readout position changes as discussed in detail below.

Detection of the state of the readout position change operator 24 involves determining whether the readout position change operator 24 has been operated by the performer. If the performer is pressing on the readout position change operator 24, a flag stored in the RAM 14 is set to a value of "1," and if the performer is not pressing on the readout position change operator 24, the flag is set to "0". In the first preferred embodiment, the determination is made by comparison of the pressure value P output by the readout position change operator 24 with a predetermined threshold value. If the pressure P is less than the threshold value, it is determined that the performer is not operating the readout position change operator 24 and the flag is set to 0. If the pressure P is greater than or equal to the threshold value it is determined that the performer is operating the readout position change operator 24 and the flag is set to 1.

Detection of the state of the readout position change operator further involves determining the coordinates (X, Y) at which the performer is pressing the readout position change operator 24 and the angular amount of change dθ from the previous detected coordinates. When the performer presses the readout position change operator 24 with his or her fingertip, the position (X, Y) is detected, and the polar coordinates of the position are determined with reference to center coordinates of the readout position change operator 24 (Xc, Yc). The change in angle dθ between the current position (Xc, Yc) and the position (Xs, Ys) at which the operator 24 was initially pressed is determined by assigning the initial coordinates (Xs, Ys) an angle of 0 degrees, and determining the angular difference dθ between the current angle θ and the previously detected angle. In other words, the angular movement of the performer's finger with respect to the reference position at the center of the readout position change operator 24 is detected, and in particular the change in angular position at each detection interval is determined. In the first preferred embodiment, clockwise angular movement is assigned a negative value dθ and counterclockwise angular movement is assigned a positive value dθ.

Returning to FIG. 2, when the operator processing S23 has been completed, other processing is executed (S24). The other processing S24 involves various tasks such as processing other register and buffer settings in response to the operation of other operators, controlling display devices, and other operations.

When the other processing S24 has been completed, processing is repeated, with key processing (S22), operator processing (S23), and other processing (S24) being repeatedly executed.

Figure 3:
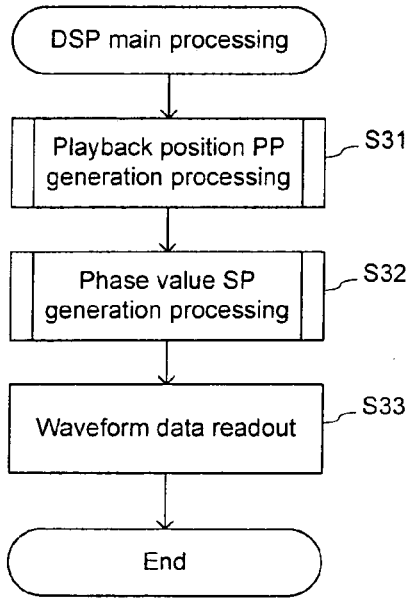
FIG. 3 is a flowchart showing main processing performed by a DSP in accordance with the first preferred embodiment.
Figure 4:
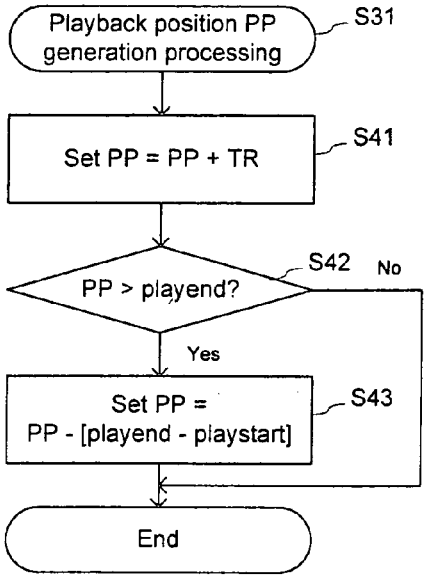
FIG. 4 is a flowchart showing playback position PP generation processing performed by the DSP.
Figure 5:
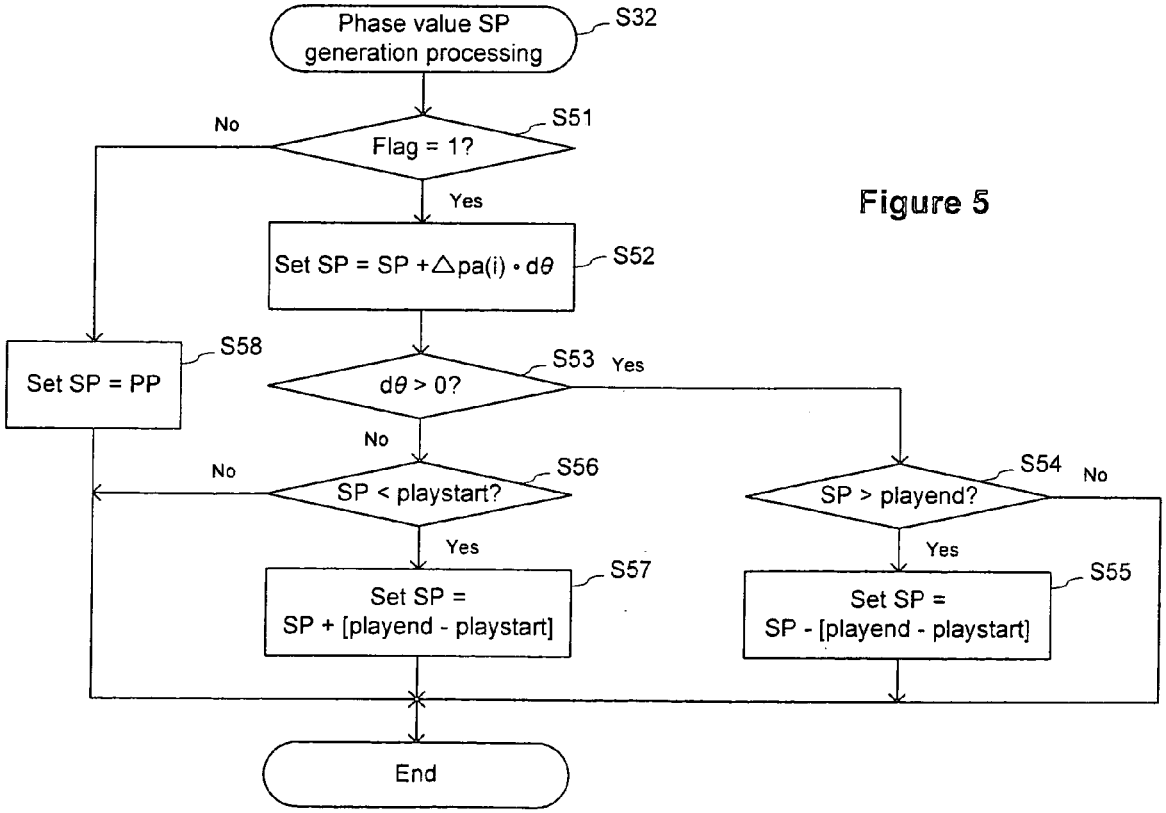
FIG. 5 is a flowchart showing readout phase value SP generation processing performed by the DSP.

Next, an explanation will be given regarding the DSP main processing that is executed by the DSP 20, while referring to the FIG. 3, FIG. 4 and FIG. 5. FIG. 3 is a flowchart that shows the DSP main processing. FIG. 4 is a flowchart that shows the playback position PP generation processing, which is used to generate playback position values PP that represent waveform data readout positions in accordance with a tempo that has been set using the tempo setting operator. FIG. 5 is a flowchart that shows the readout phase value SP generation processing, which is used to generate phase values SP that are used as waveform data readout positions. When the readout position change operator 24 is being used, the readout phase values SP are determined in accordance with the amount by which the readout position change operator is operated. When the readout position change operator 24 is not being used, the phase values SP are equal to the playback position values PP.

As shown in the flowchart of FIG. 3, when a key of the keyboard 18 has been pressed and a sound generation start instruction is directed from the CPU 10 to the DSP 20, the DSP 20 executes playback position PP generation processing that is shown in FIG. 4 (S31) and then executes the phase value SP generation processing that is shown in FIG. 5 (S32). Waveform data are then read out from the waveform memory 16 based on the phase value SP by the DSP 20 (S33). This processing cycle is repeated in sequence, with the readout phase value SP being updated during each cycle in accordance with the performer's operation of the readout position change operator, thus providing performer control over the readout position of the waveform data.

Referring to FIG. 4, the playback position PP processing generates waveform data readout positions in accordance with playback at a tempo that has been set by the tempo setting operator. The playback position PP indicates the readout position of the waveform data in the waveform memory. When playback position PP generation processing S31 is executed, a current playback position PP is calculated by adding a stepping value TR (time rate) to the playback position PP determined at the previous execution of the playback position PP generation processing (S41). In the first preferred embodiment, the stepping value TR is related to a number of sampling periods at the sampling frequency of the waveform data (for example, 44.1 kHz). Where the tempo set by the tempo setting operator is the same as original tempo of the waveform data, the stepping value TR equals 1. If the playback tempo is greater than the original tempo, TR is greater than 1, and if the playback tempo is less than the original tempo, TR is less than 1. Thus the stepping value TR is changed to match the playback tempo that has been set by the tempo setting operator.

After the playback position PP has been computed, it is determined whether the playback position PP is greater than the playback end position Playend (S42). If the playback position PP is greater than the playback end position Playend (S42: yes), the end of the segment of the waveform data to be played back has been reached, and so the playback position PP is moved backward by an amount equal to the length of the playback segment (S43), effectively causing playback to loop back to the beginning of the playback segment. The processing routine then terminates. On the other hand, if the playback position PP is not greater than the playback end position Playend (S42: no), no change is made and the processing routine terminates. Thus, this processing generates a playback position between the playback start position Playstart to the playback end position Playend at the tempo set by the tempo setting operator during each processing cycle of the DSP through periodic incrementing of the playback position PP by the stepping amount TR.

Further teaching regarding techniques for playing back waveform data in accordance with an arbitrary tempo set by a performer are provided in Japanese Unexamined Patent Application Publication (Kokai) Number 2001-188544, which is incorporated herein by reference in its entirety for those teachings.

Referring now to FIG. 5, the readout phase value SP generation processing generates readout phase values SP in accordance with the operation of the readout position change operator 24. The readout phase value SP is changed in conformance with the amount of operation of the readout position change operator 24.

In S32, when the execution of the readout phase value SP generation processing is initiated, it is determined whether the flag value is 1 (S51). If the flag value is 1 (S51: yes), it is indicated that the performer is operating the readout position change operator 24, and the readout phase value SP is set to a value that corresponds to the amount of operation of the readout position change operator 24 (S52 to S57). An explanation will be given below regarding the processing of S52 to S57.

When the performer operates the readout position change operator 24, a readout phase value SP determined in a previous processing cycle is incremented by an amount equal to the product of the angular movement dθ of the performer's finger on the operator 24 since the last processing cycle and a predetermined amount of phase value change per degree of movement Δpa (S52). In accordance with the first preferred embodiment, the amount of phase value change may be calibrated to provide a known relationship between an amount of operation (e.g. 180 degrees) of the readout position change operator 24 and a number of musical time units of the waveform data (e.g. one beat or one bar), such that the performer is assisted in shifting the readout position of the waveform data with respect to the automatic performance data by a desired number of musical time units. Additional teaching regarding techniques for adjustment of the waveform data readout position in amounts corresponding to musical time units is provided in U.S. Published Patent Application Number 2002-0046639, the entirety of which is incorporated herein by reference for those teachings.

Once the readout phase value SP is set, it is determined whether the amount of operation dθ was positive or negative (S53). In other words, it is determined whether the performer has operated the readout position change operator 24 counterclockwise or clockwise, thus indicating the direction of the readout position change.

In the case where dθ was positive (S53: yes), the waveform data readout position is advanced, and so it is determined whether the readout phase value SP exceeds the playback end position Playend (S54). If the phase value SP exceeds the playback end position Playend (S54: yes), the end of the waveform playback segment has been reached, and the readout phase value SP is moved backward by an amount equal to the length of the playback segment, (S55), effectively causing playback to loop back to the beginning of the playback segment. On the other hand, if dθ was positive but the phase value SP does not exceed the playback end position Playend (S54: no), the end of the playback segment has not been reached and the phase value SP does not have to be changed.

In the case where dθ was negative (S53: no), the waveform data readout position is to be moved backward, and so it is determined whether the phase value SP is less than the playback start position Playstart (S56). If the phase value SP is less than playback start position Playstart (S56: yes), the readout position has moved backward past the beginning of the waveform playback segment, and the readout phase value SP is moved forward by an amount equal to the length of the playback segment (S57), effectively causing playback to loop back to the end of the playback segment. On the other hand, if dθ was negative but the phase value SP exceeds the playback start position Playstart (S56: no), the beginning of the playback segment has not been reached and the phase value SP does not have to be changed.

Returning to the beginning of the processing, if the flag has a value of 0 (S51: no), it is determined that the performer is not operating the readout position change operator 24, the phase value SP is set to the playback position PP (S58) previously determined. Consequently, the readout phase value SP is used to indicate the waveform data readout position whenever waveform data is being reproduced. If the readout position change operator 24 is not being used, the readout phase value SP is equal to the playback position PP, and so readout is synchronized with the tempo previously set by the performer. If the readout position change operator 24 is being used, the readout phase value SP is determined in accordance with the amount of operation of the readout position change operator, and the readout position is changed accordingly. The performer's operation of the readout position change operator 24 may cause the waveform data to be played through multiple times in either a forward or a reverse direction to produce the various effects, as described above. When the readout position change operator 24 ceases to be used, the readout phase value SP is again made equal to the playback position PP, which has been continuously updated in each DSP processing cycle. This causes playback of the waveform data to return to synchronization with the previously set tempo, such that played continues from a position that would be the current playback position had the readout position change operator 24 not been used. Thus playback of the waveform data may be altered through use of the readout position change operator 24, and when the performer ceases to use the readout position change operator 24, playback is resynchronized with the tempo previously set using the tempo setting operator.

Because the above-described processing updates values for both synchronized reproduction at the set tempo (PP) and the readout position indicated by operation of the readout position change operator (SP) in each DSP processing cycle, the device may return to playback in synchronization with the original tempo using the playback position values PP once the performer has ceased operation of the readout position phase operator 24.

Next, an explanation will be given regarding a second preferred embodiment. In the first preferred embodiment, the readout phase value SP is changed based on the amount of operation dθ of the readout position change operator 24. In contrast, in the second preferred embodiment, a bender is furnished and the readout phase value SP is changed based on the amount of operation of the bender. The remainder of the configuration of the electronic musical instrument 1 for the second preferred embodiment is essentially the same as for the first preferred embodiment.

The bender of the second preferred embodiment is preferably implemented as a lever that can be moved left, right and forward, and that automatically returns to the center position when it is not being used. The electronic instrument is preferably configured such that when the lever is moved fully to the left, a timer value of 0.0 is produced, when the lever is in the center, a timer value of 1.0 is produced, and when the lever is moved fully to the right, a timer value of 2.0 is produced. Movement of the lever to intermediate positions generates corresponding intermediate timer values. Further, when the lever is moved forward, a switch is turned on, setting the value of a "Trip Flag" to equal 0, which indicates termination of use of the bender as described below.

Figure 6:
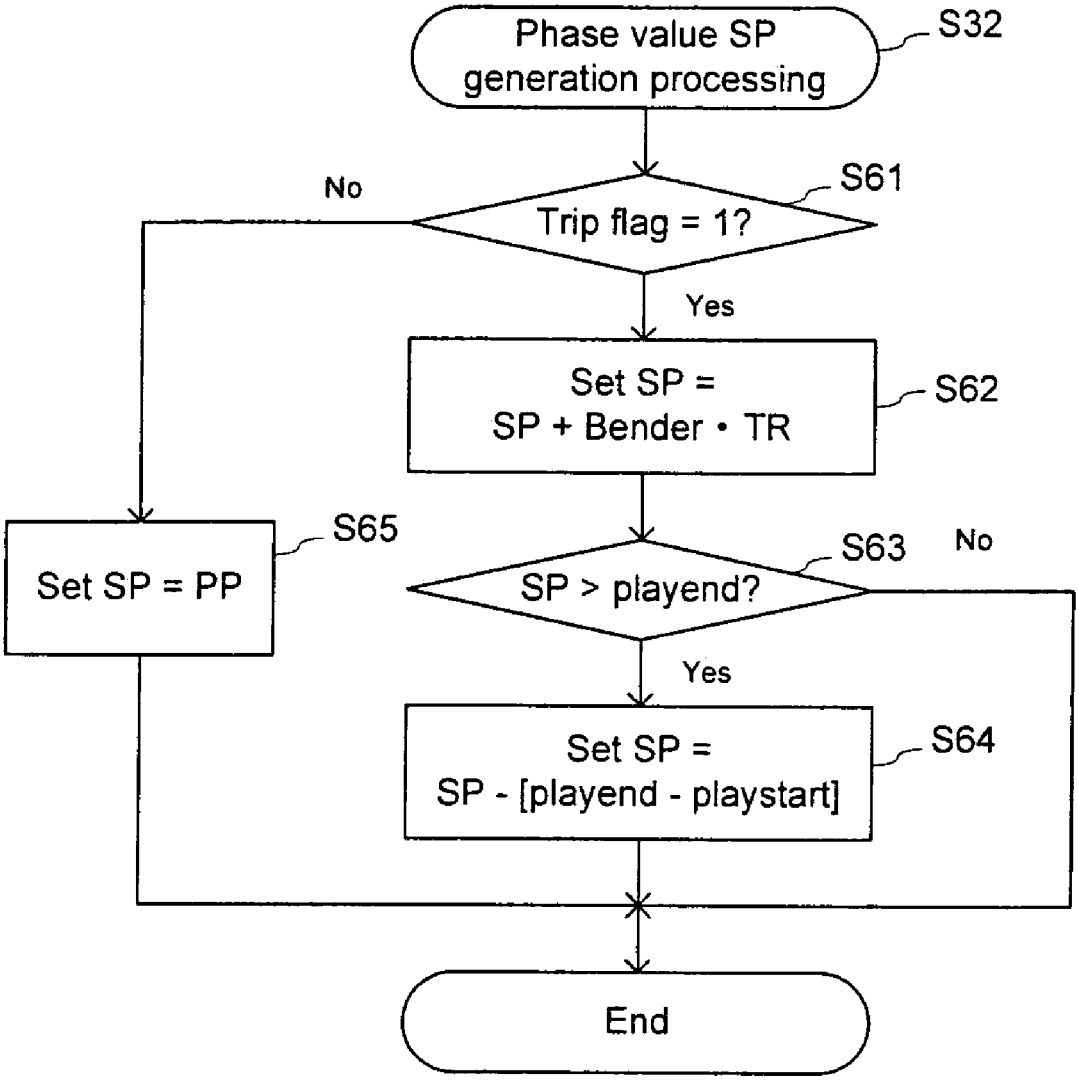
FIG. 6 is a flowchart showing readout phase value SP generation processing performed by the DSP in accordance with a second preferred embodiment.

An explanation will be given here with reference to FIG. 6 regarding the readout phase value SP generation processing using the bender of the second preferred embodiment. The processing of FIG. 6 shows the readout phase value SP generation processing that is executed by the DSP 20 in place of the processing of FIG. 5. When the execution of the readout phase value SP generation processing is initiated (S32), the value of the Trip Flag is determined. In this embodiment, the Trip Flag value is set to 1 when the bender is being operated. Moving the bender lever to the down forward position as described above sets the Trip Flag value back to 0, effectively providing an "off" function that is similar to removing pressure from the readout position change operator 24 in the first embodiment.

If it is determined that the Trip Flag value is 1 (S61: yes), it is indicated that the performer is operating the bender, and the readout phase value SP is updated by incrementing the phase value SP determined in the previous processing cycle by a stepping value Bender TR that corresponds to the timer value produced by the bender (S62). It is then determined whether the readout phase value SP is greater than the playback end position Playend. If the readout phase value SP exceeds the playback end position Playend (S63: yes), the end of the waveform playback segment has been exceeded, and the readout phase is moved backward by an amount equal to the length of the playback segment (S64), effectively causing playback to loop back to the beginning of the playback segment. On the other hand, if the readout phase value SP does not exceed the playback end position Playend (S63: no), the end of the playback segment has not been reached and the phase value SP does not have to be changed.

Returning to the beginning of the process, if it is determined that the Trip Flag value is 0 (S61: no), it is indicated that that the performer is not operating the bender or the lever has been brought to the down forward position, the readout phase value SP is set to the playback position PP (S65). As in the first embodiment, this effectively resynchronizes playback of the waveform data with the tempo previously set by the performer. Thus, the electronic musical instrument 1 of the second preferred embodiment provides the same advantageous result as the first preferred embodiment by means of the operation of the bender.

While the preferred embodiments described above used the readout position change operator 24 and bender to control the readout of waveform data, in other embodiments these may be used to control reproduction of automatic performance data, such as one or more tracks of automatic performance data among multiple tracks of automatic performance data, providing similar control and effects using automatic performance data.

Further, while the preferred embodiments initiate reproduction of waveform data in response to the pressing of a keyboard key without relying on the timing of the pressing of the key to indicate the starting time of waveform reproduction, in alternative embodiments the synchronization of the waveform data relative to other data may be based on the time at which the performer presses the key.

In addition, while the preferred embodiments employ a tempo setting operator to indicate a playback tempo, alternative embodiments may obtain a playback tempo from another source such as a MIDI signal.

The preferred embodiments also employ waveform data having a defined playback segment that is reproduced in a looped fashion. However, a longer playback that is not looped or repeated may be used.

Further, while the first preferred embodiment returns to synchronization with the original tempo when the performer ceases use of the readout position change operator, in alternative embodiments the return to synchronization may occur at a desired timing. This may be provided even in those cases where the bender is operated forward without any relationship to the operation of the readout position change operator 24.

Further, while in the preferred embodiment the return to synchronization occurs upon release of pressure from the readout position change operator 24, in alternative embodiments the return to synchronization may be made to occur after the passage of a predetermined amount of time during which the location of pressure on the readout position change operator 24 does not change.

Thus, in general terms, embodiments of the invention pertain to an electronic instrument that produces an audio signal from waveform data. The tempo for reproduction of the waveform data may be set to an arbitrary value by a performer. During reproduction of the waveform data, first waveform data readout positions (e.g. playback position values PP) are generated in accordance with the playback tempo set by the performer. The first readout positions indicate the location in the waveform data at which readout occurs for reproduction at the previously set tempo in synchronization with the original initiation of playback. Thus, at any time, the first readout positions may be used to provide playback at the set tempo in synchronization with the original initiation of playback.

The performer is enabled to temporarily manipulate reproduction of the waveform through the use of a readout position change operator. The operation of the readout position change operator generates second waveform data readout positions (e.g. readout phase values SP) that are temporarily used as readout positions while the operator is being used. The use of the operator allows the performer to move the readout positions forward or backward with respect to the first readout positions, thus causing playback of the waveform to be shifted, sped up, slowed down or reversed with respect to normal reproduction at the previously set tempo. When the performer ceases use of the operator, playback of the waveform returns to synchronization with the previously set tempo through use of the first waveform data readout positions.

The readout position change operator may be implemented as a pressure sensitive surface. The application of pressure to the surface and movement of the location of pressure may indicate the amount and direction of readout position change, and release of pressure may indicate termination of use of the operator. The readout position change operator may also be implemented as a bender lever. Movement of the lever in predetermined directions may indicate the amount and direction of readout position change, and movement of the lever in a predetermined direction may indicate termination of use of the operator. The operator may be calibrated such that a predetermined amount of movement corresponds to a shift by a predetermined amount of units of musical time such as beats or bars.

The features described above are not exclusive of other features and variations. While the embodiments illustrated in the figures and described above are presently preferred, these embodiments are offered by way of example only. The invention is not limited to a particular embodiment, but extends to various modifications, combinations, and permutations that fall within the scope of the inventions as claimed and their equivalents.

What is claimed is:

1. An electronic musical instrument, comprising:

a waveform memory storing audio waveform data;

a tempo setting operator for receiving user input specifying a playback tempo for the waveform data;

a readout position change operator that is operable by a user to indicate, during operation of the readout position change operator, a desired amount of waveform data readout position change; and a computer readable medium storing programming instructions for causing the instrument to perform processing comprising:

generating first waveform data readout positions in accordance with a playback tempo set by the tempo setting operator;

when the readout position change operator is being operated, generating second waveform data readout positions during and in accordance with operation of the readout position change operator and playing back said audio phrase in accordance with said second waveform data readout positions; and after the duration of operation of the readout position change operator, when the readout position change operator is not being operated, playing back said audio phrase in accordance with said first waveform data readout positions;

wherein, upon termination of operation of the readout position change operator, playback of the waveform data returns to synchronization with the specified playback tempo at a readout position that would be the current readout position had the readout position change operator not been operated.

2. The instrument claimed in claim 1, wherein the readout position change operator comprises a pressure sensitive surface, wherein operation of the readout position change operator is indicated by the application of at least a predetermined amount of pressure to the surface, and wherein an amount of readout position change is indicated by an amount of angular movement of a location of said pressure on the surface with respect to a reference point.

3. The instrument claimed in claim 2, wherein angular movement in a first direction indicates forward movement of the second readout positions with respect to the first readout positions, and angular movement in a second direction indicates backward movement of the second readout positions with respect to the first readout positions.

4. The instrument claimed in claim 2, wherein angular movement by a predetermined amount indicates a readout position change corresponding to a predetermined unit of musical time of the waveform data.

5. The instrument claimed in claim 1, wherein the readout position change operator comprises a bender lever, wherein an amount of readout position change is indicated by an amount of movement of the lever in either a first direction or a second direction opposite said first direction.

6. The instrument claimed in claim 5, wherein movement of the lever in the first direction indicates forward movement of the second readout positions with respect to the first readout positions, and movement of the lever in the second direction indicates backward movement of the second readout positions with respect to the first readout positions.

7. The instrument claimed in claim 5, wherein termination of use of the bender lever is indicated by movement of the lever in a third direction different from the first and second directions.

8. A method for producing an audio signal from audio waveform data, comprising:

generating first waveform data readout positions for producing said audio signal at a specified playback tempo;

during detecting operation of a readout position change operator, generating second waveform data readout positions in accordance with operation of the readout position change operator and producing said audio signal from the audio waveform data in accordance with said second waveform data readout positions; and after the duration of operation of the readout position change operator, when the readout position change operator is not being operated, producing said audio signal from the audio waveform data using said first waveform data readout positions;

wherein, upon termination of operation of the readout position change operator, playback of the waveform data returns to synchronization with the specified playback tempo at a readout position that would be the current readout position had the readout position change operator not been operated.

9. The method claimed in claim 8, wherein the readout position change operator comprises a pressure sensitive surface, wherein operation of the readout position change operator is indicated by the application of at least a predetermined amount of pressure to the surface, and wherein an amount of readout position change is indicated by an amount of angular movement of a location of said pressure on the surface with respect to a reference point.

10. The method claimed in claim 9, wherein angular movement in a first direction indicates forward movement of the second readout positions with respect to the first readout positions, and angular movement in a second direction indicates backward movement of the second readout positions with respect to the first readout positions.

11. The method claimed in claim 9, wherein angular movement by a predetermined amount indicates a readout position change corresponding to a predetermined unit of musical time of the waveform data.

12. The method claimed in claim 8, wherein the readout position change operator comprises a bender lever, wherein an amount of readout position change is indicated by an amount of movement of the lever in either a first direction or a second direction opposite said first direction.

13. The method claimed in claim 12, wherein movement of the lever in the first direction indicates forward movement of the second readout positions with respect to the first readout positions, and movement of the lever in the second direction indicates backward movement of the second readout positions with respect to the first readout positions.

14. The method claimed in claim 12, wherein termination of use of the bender lever is indicated by movement of the lever in a third direction different from the first and second directions.

* * * * *